US005885090A

United States Patent [19]

Comstock et al.

[11] Patent Number: 5,885,090

[45] Date of Patent: Mar. 23, 1999

[54] ELECTRICAL CONNECTOR WITH STABILIZED OFFSET SPRING ARM

[75] Inventors: Gary M. Comstock, LaGrange; Arvind Patel, Naperville; Yew-Teck Yap, Lisle, all of Ill.

[73] Assignee: Molex Incorporated, Lisle, Ill.

[21] Appl. No.: 823,296

[22] Filed: Mar. 21, 1997

[51] Int. Cl.[6] ..... H01R 13/41; H01R 13/24

[52] U.S. Cl. ..... 439/65; 439/733.1; 439/862; 439/943

[58] Field of Search ..... 439/733.1, 79, 439/80, 862, 65, 943

[56] References Cited

U.S. PATENT DOCUMENTS

| | | | |
|---|---|---|---|
| 3,192,498 | 6/1965 | Ruehlemann | 339/33 |
| 4,356,532 | 10/1982 | Donaher et al. | 361/393 |
| 4,505,035 | 3/1985 | Burton et al. | 439/79 |
| 4,660,911 | 4/1987 | Reynolds et al. | 439/83 |
| 5,201,662 | 4/1993 | Roche | 439/79 |
| 5,338,230 | 8/1994 | Bryce et al. | 439/629 |
| 5,453,028 | 9/1995 | Grambley et al. | 439/441 |
| 5,487,674 | 1/1996 | Guzik et al. | 439/83 |

*Primary Examiner*—Neil Abrams
*Attorney, Agent, or Firm*—Stephen Z. Weiss

[57] ABSTRACT

An electrical connector (10) includes a dielectric housing (12) having a terminal-receiving passage (14) for insertion thereinto of a terminal (16) in a given insertion direction (A). The terminal includes a first spring contact arm (22) projecting into the passage (14) for engagement by an appropriate first mating conductor. An engagement arm (26) is in line with the first spring contact arm (22) to provide an engagement shoulder for an insertion tool which forces the terminal (10) into the passage (14) of the housing. A second spring contact arm (24) is offset laterally of the insertion direction (A) from the first spring contact arm (22) out of a path for the insertion tool to the engagement arm. The second spring contact arm (24) is adapted for engagement by an appropriate second mating conductor.

8 Claims, 3 Drawing Sheets

ELECTRICAL CONNECTOR WITH STABILIZED OFFSET SPRING ARM

FIELD OF THE INVENTION

This invention generally relates to the art of electrical connectors and, particularly, to an electrical connector which includes a unique terminal configuration.

BACKGROUND OF THE INVENTION

Generally, electrical connectors include a dielectric housing mounting a plurality of conductive terminals for making electrical connection between a pair of electrical devices or conductors. For instance, an electrical connector may interconnect a conductor of an electrical wire to a circuit trace on a printed circuit board. A connector may interconnect a battery contact with a circuit trace on a printed circuit board. Electrical connectors have been provided in a myriad of designs and constructions.

Various electrical connector assemblies include terminals which have rigid base sections for securing the terminals in the dielectric housing of the connector assembly. Other portions of the terminals, such as contact means, spring contact arms, etc. project from the rigidly secured base sections. Such terminals may be fabricated as stamped and formed sheet metal components, with the base sections of the terminals being forced into cavities in the dielectric housing. The base sections may include barbs along opposite edges thereof for skiving into the plastic material of the housing for rigidly securing the terminal in its cavity.

For instance, these types of terminals are used in recharging and data retrieval apparatus, such as a portable telephone. A hand held phone set is positionable into and removed from a cradle formed by a base unit. The hand held phone set has exposed contact means, and the base unit often has a plurality of spring contact arms exposed thereon for engaging the contact means of the hand held phone set, such as for recharging the batteries thereof. The terminals of the base unit include base sections insertable into cavities in a dielectric housing to secure the terminals thereon, with the spring contact arms projecting from the base sections for engaging the contact means of the hand held phone set. The terminals also may include solder tails for engaging circuit traces on a circuit board within the base unit.

One of the problems with such electrical connector assemblies involves mounting or inserting the terminals into their respective cavities. Insertion tools often are used for inserting the terminals into their cavities, and the insertion forces must be transmitted to the base sections of the terminals which are rigidly secured to the housing. This problem is magnified when the terminals include more than one spring contact arm, such as when a terminal has one spring contact arm for surface engaging a contact of a battery and a second spring contact arm for surface engaging a circuit trace on a printed circuit board. The present invention is directed to solving these problems in an electrical connector having one or more terminals of the character described.

SUMMARY OF THE INVENTION

An object, therefore, of the invention is to provide an electrical connector assembly with a new and improved terminal construction.

In the exemplary embodiment of the invention, an electrical connector includes a dielectric housing having a terminal-receiving passage for insertion thereinto of a terminal in a given insertion direction. The terminal includes a base insertable into the passage and having a center-line generally parallel to the given insertion direction. The terminal includes a first cantilevered spring contact arm, an engagement arm and a second cantilevered spring contact arm. The first spring contact arm is in line with the base and projects from the base into the passage for engagement by an appropriate first mating conductor, such as a battery contact. The engagement arm projects from the base generally on the center-line to provide an engagement shoulder for an insertion tool which forces the terminal into the terminal-receiving passage of the housing. The second spring contact arm is joined to the base by a web extending laterally from a side edge of the base so that the second spring contact arm is transversely offset from the first spring contact arm. The second spring contact arm, therefore, is out of the path for the insertion tool to the engagement arm and is adapted for engagement by an appropriate second mating conductor, such as a circuit board contact.

Preferably, the base includes retention means for holding the terminal in the terminal-receiving passage. As disclosed herein, the retention means comprise teeth formed at opposite edges of the base for skiving into the housing along the terminal-receiving passage.

The dielectric housing includes a slot communicating with the terminal-receiving passage for receiving a fixed end of the second cantilevered spring contact arm. The fixed end of the arm includes a raised boss for establishing an interference fit in the slot.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
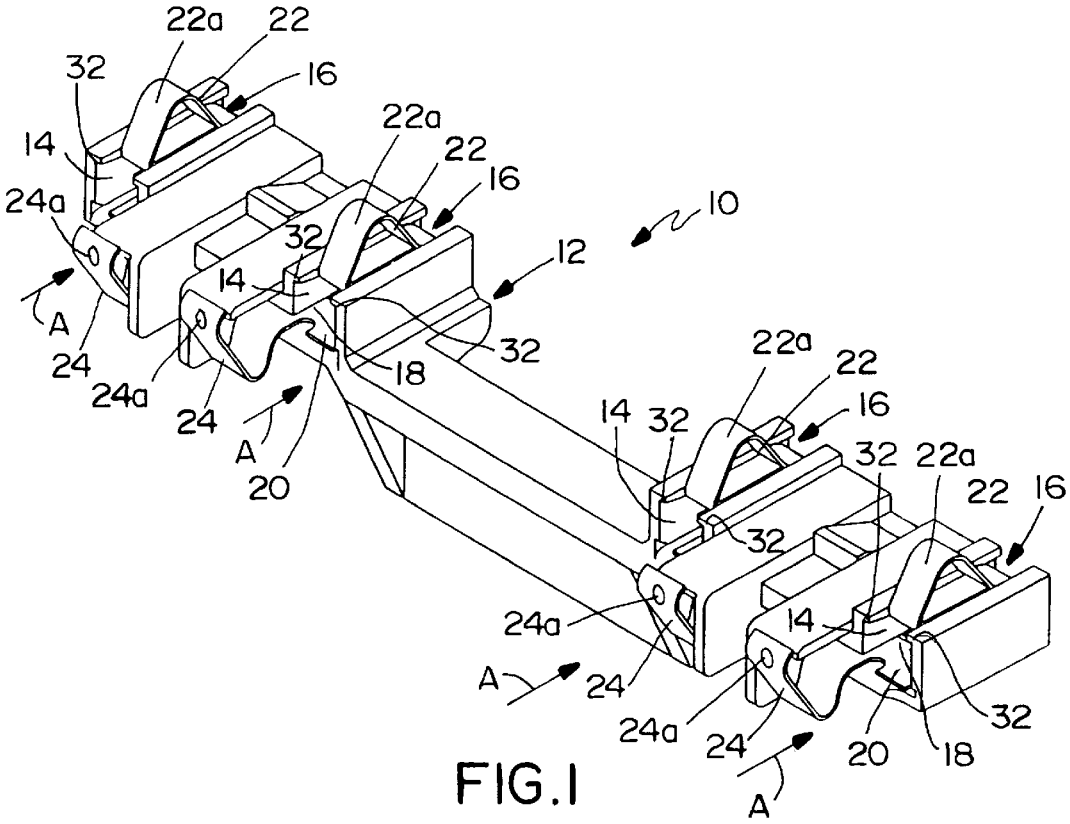
FIG. 1 is a perspective view of an electrical connector mounting a plurality of terminals according to the invention.
Figure 2:
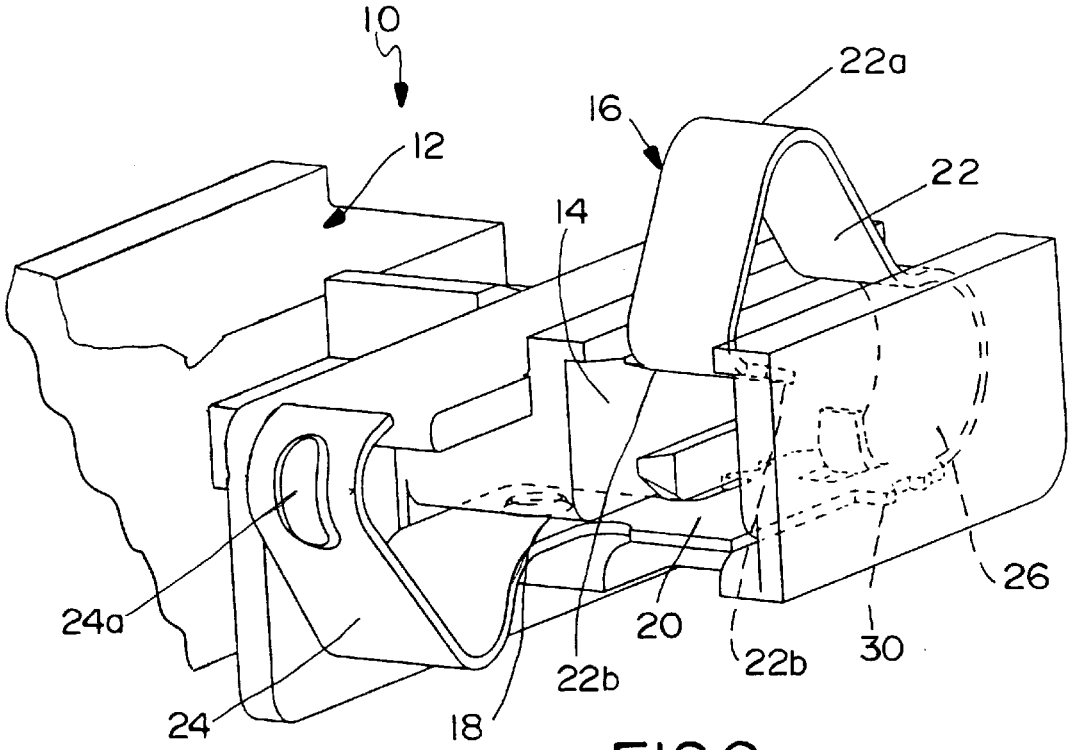
FIG. 2 is a perspective view of the terminal at the right-hand end of the connector of FIG. 1.
Figure 3:
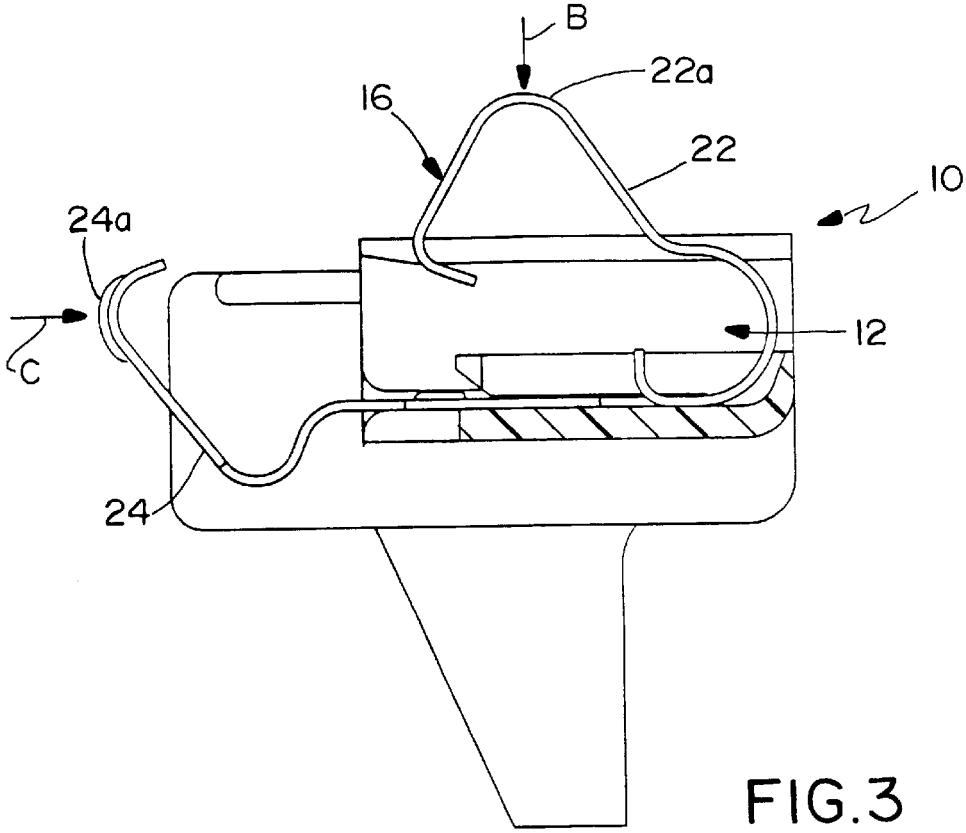
FIG. 3 is a section elevational view of the connector.

Referring to the drawings in greater detail, and first to FIGS. 1–3, an electrical connector, generally designated 10, includes an elongated dielectric housing, generally designated 12, such as a one-piece structure unitarily molded of plastic material or the like. The housing has a plurality of terminal-receiving passages 14 for insertion thereinto of a plurality of terminals, generally designated 16, in a given insertion direction as indicated by arrows "A" (FIG. 1). A narrow slot 18 in housing 12 communicates with terminal-receiving passage 14 and extends transversely therefrom, i.e. transversely of insertion direction "A".

Generally, each terminal 16 includes a base 20, a first cantilevered spring contact arm 22 projecting from the base into a respective one of the terminal-receiving passages 14 and a second cantilevered spring contact arm 24 offset from the base transversely of the insertion direction. As will be seen below, the terminals are adapted for interconnecting a pair of conductors, such as interconnecting a surface contact of a battery with a surface contact of a printed circuit board.

Figure 5:
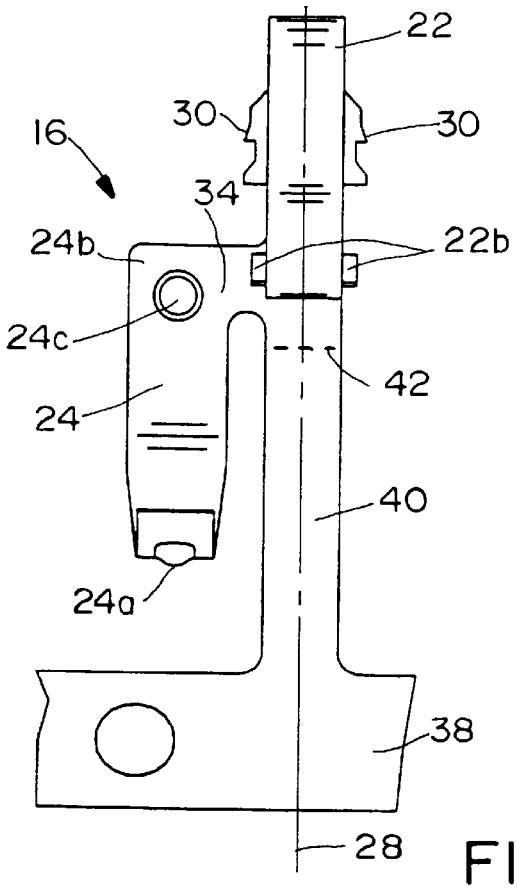
FIG. 5 is a plan view of one of the terminals joined to the carrier strip.
Figure 4:
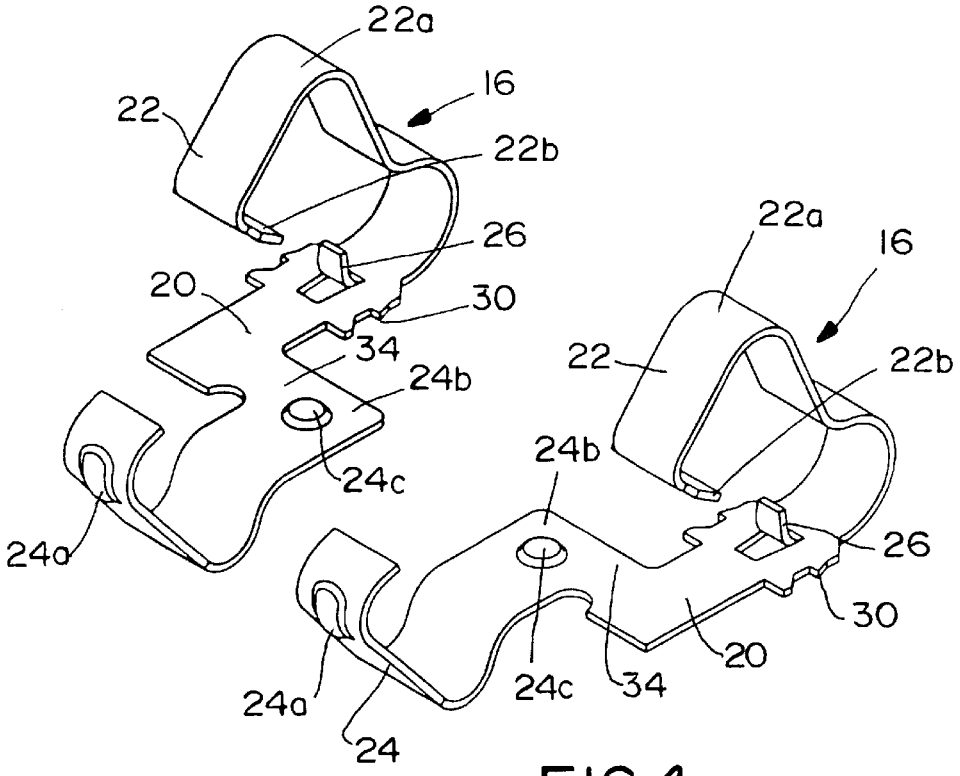
FIG. 4 is a perspective view of a plurality of terminals after being severed from a carrier strip during manufacture.

More particularly, referring to FIGS. 4 and 5 in conjunction with FIGS. 1–3, base 20 of each terminal 16 is generally flat or planar and includes an engagement arm 26 stamped therefrom so that the engagement arm projects upwardly from the base as best seen in FIG. 4. The base defines a center-line 28 (FIG. 5) which is generally parallel to the given insertion direction of the terminal into its respective terminal-receiving passage 14, as indicated by direction "A". The engagement arm 26 of the respective terminal is generally on center-line 28 to provide an engagement shoulder for an insertion tool which forces the terminal into its terminal-receiving passage 14 in housing 12. Retention means in the form of teeth 30 at opposite edges of base 20 skive into the plastic material of the housing along the terminal-receiving passage to hold the terminal in the passage.

First cantilevered spring contact arm 22 of each terminal 16 projects from the base 20 of the terminal and into the respective passage 14 and outwardly of the housing as seen clearly in FIGS. 1–3. The spring contact arm has a bowed contact portion 22*a* adapted for surface engagement with a contact of a battery, for instance. The spring contact arm is folded back downwardly and terminates in a pair of outwardly projecting tabs 22*b* which slide under ledges 32 (FIGS. 1 and 2) on opposite sides of each terminal-receiving passage 14. Engagement of tabs 22*b* beneath ledges 32 provide an anti-over stress means to prevent the first spring contact arms 22 from being pulled upwardly away from the housing.

Figure 6:
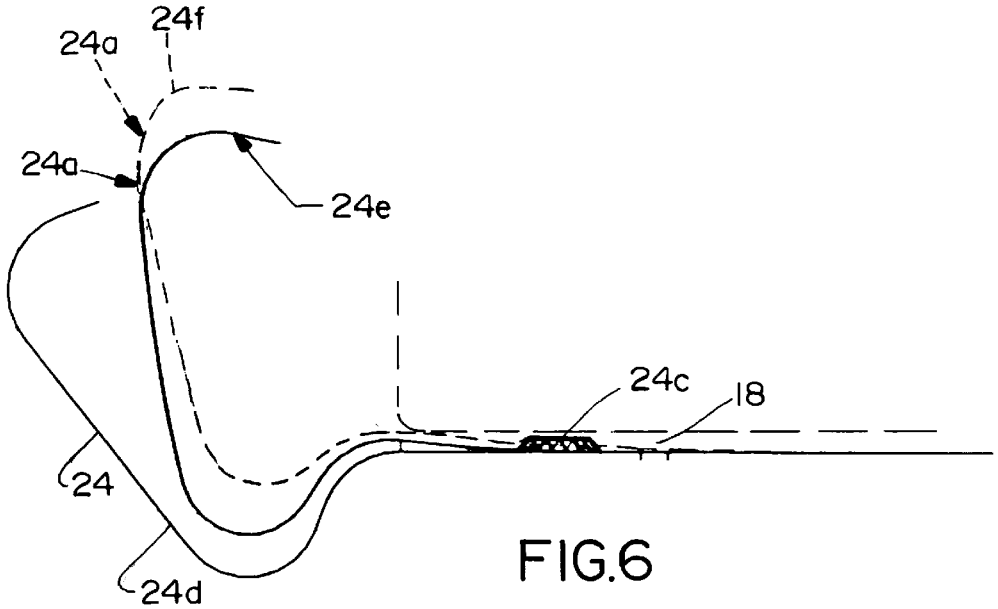
FIG. 6 is a finite element analysis of an elevator view of the terminal with and without a raised boss.

Second cantilevered spring contact arm 24 of each terminal 16 is joined to the base 20 of the terminal by a web 34 which extends laterally from one side edge of the base so that the second spring contact arm 24 is transversely offset from the first spring contact arm 22 of the respective terminal. In other words, second spring contact arm 24 is offset transversely away from center-line 28 of the terminal, as is seen most clearly in FIG. 5. This positions the second cantilevered spring contact arm out of the path of the insertion tool to engagement arm 26 which is on the center-line of base 20. The second spring contact arm 24 has a rounded contact portion provided with a stamped dimple 24*a* for engagement with a second mating conductor, such as a surface contact on a printed circuit board. Finally, the second spring contact arm 24 of each terminal has a fixed end 24*b* unitary with web 34, and a raised boss 24*c* is formed on the fixed end for establishing a minimum clearance slip fit within the respective slot 18 in housing 12. In other words, raised boss 24*c* effectively increases the thickness of the fixed end 24*b* to provide a minimum clearance slip fit within the slot. The boss helps to improve the bend characteristics of the spring contact arm 24. FIG. 6 is a finite element analysis deformed shape plot of spring arm 24 prepared from Hyper Mesh Software Version 2.00f published by Altair Computing, Inc., 1757 Maplelawn Drive, Troy, Milch. 48084. Plot marked 24*d* shows the terminal at rest. Plot marked 24*e* shows the terminal with raised boss 24*c* being acted upon by a force through a given deflection. Plot marked 24*f* shows the terminal without the raised boss being deflected the same distance. The plots 24*e* and 24*f* clearly show that the spring contact arm 24 has less lateral movement with the raised boss 24*c* than without the raised boss. Also the software shows that the force of the contact point (raised dimple 24*a*) while moved through the given deflection is greater when a raised boss is used.

Terminals 16 are stamped and formed from conductive sheet metal material. FIG. 5 shows how the stamped and formed terminals are mass produced as joined to a carrier strip 38 during manufacture. Each respective terminal is joined to the carrier strip by a leg 40. The terminals are separated from the legs along dotted lines 42. The terminals are inserted into housing 12 in the insertion direction "A" by an appropriate insertion tool engaging arms 26 projecting from bases 20 of the terminals.

With the terminals stamped and formed of sheet metal material, first and second cantilevered spring contact arms 22 and 24, respectively, are inherently resilient. In use, and referring particularly to FIG. 3, contact portion 22*a* of spring contact arm 22 will biasing engage an appropriate first mating conductor, such as a surface contact of a battery, which will apply pressure to the contact arm in the direction of arrow "B". Second spring contact arm 24 also will biasing engage an appropriate second mating conductor, such as a surface contact of a printed circuit board, which will apply pressure to contact portion 24*a* of the spring contact arm in the direction of arrow "C". Therefore, it can be seen that each terminal provides two distinct resilient contact arms projecting from housing 12, yet means still are provided for efficiently inserting the terminals into the terminal-receiving passages of the housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

A dielectric housing having a terminal in a given insertion direction, the terminal including a base insertable into the passage and having a center-line generally parallel to said given insertion direction, the terminal including a first cantilevered spring contact arm in line with the center line of the base and projecting from the base into the passage for engagement by an appropriate first mating conductor, the terminal including a tool engagement arm projecting from the base generally on said center-line to provide an engagement shoulder for an insertion tool which forces the terminal into the terminal-receiving passage of the housing, the terminal including a second cantilevered spring contact arm joined to the base by a web extending laterally from a side edge of the base so that the second cantilevered spring contact arm is transversely offset from the first cantilevered spring contact arm out of a path traveled by the insertion tool to the engagement arm and adapted for engagement by an appropriate second mating conductor, the dielectric housing including a slot communicating with the terminal-receiving passage for receiving a fixed end of the second cantilevered spring contact arm, and the fixed end of the second cantilevered spring contact arm including a raised boss for establishing a minimum clearance fit in said slot.

2. The electrical connector of claim 1 wherein said base includes retention means for holding the terminal in the terminal-receiving passage.

3. The electrical connector of claim 2 wherein said retention means comprise teeth formed at opposite edges of the base for skiing into the housing along the terminal-receiving passage.

4. The electrical connector of claim 1 wherein said terminal is stamped and formed of sheet metal material.

5. An electrical connector, comprising:

a dielectric housing having a terminal-receiving passage for insertion therein to of a terminal in a given insertion direction, the terminal including a first spring contact arm projecting into the passage for engagement by an appropriate first mating conductor, the terminal including a second spring contact arm offset laterally from said insertion direction from first spring contact arm out of a path traveled by the insertion tool to the engagement arm and adapted for engagement by an appropriate second mating conductor, the dielectric housing including a slot communicating with the terminal-receiving passage for receiving a fixed end of the second cantilevered spring contact arm, and the fixed end of the second cantilevered spring contact arm including a raised boss for establishing minimum clearance fit in said slot.

6. The electrical connector of claim 5 wherein the terminal includes retention means for holding the terminal in the terminal-receiving passage.

7. The electrical connector of claim 6 wherein said retention means comprise teeth formed at opposite edges of the terminal for skiing into the housing along the terminal-receiving passage.

8. The electrical connector of claim 5 wherein said terminal is stamped and formed of sheet metal material.

* * * * *